US009254402B2

(12) United States Patent
Hsu et al.

(10) Patent No.: US 9,254,402 B2
(45) Date of Patent: Feb. 9, 2016

(54) MOVEMENT FACILITATIVE DEVICE

(75) Inventors: Mau-Pin Hsu, Taipei (TW); Jheng-Ying Lin, Taipei (TW); Jia-Yang Liang, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 727 days.

(21) Appl. No.: 13/554,152

(22) Filed: Jul. 20, 2012

(65) Prior Publication Data

US 2013/0023803 A1 Jan. 24, 2013

(30) Foreign Application Priority Data

Jul. 21, 2011 (TW) ..... 100125742 A

(51) Int. Cl.

| | |
|---|---|
| ***A61H 1/02*** | (2006.01) |
| ***A63B 21/00*** | (2006.01) |
| ***A63B 69/00*** | (2006.01) |
| ***A63B 25/10*** | (2006.01) |
| *A61H 3/00* | (2006.01) |
| *A63B 21/005* | (2006.01) |

(52) U.S. Cl.

CPC ..... *A63B 21/00181* (2013.01); *A63B 21/1423* (2013.01); *A63B 25/10* (2013.01); *A63B 69/0028* (2013.01); *A61H 1/024* (2013.01); *A61H 3/00* (2013.01); *A61H 2201/1207* (2013.01); *A61H 2201/1642* (2013.01); *A61H 2201/5061* (2013.01); *A63B 21/0058* (2013.01); *A63B 2220/51* (2013.01)

(58) Field of Classification Search

CPC ..... A63B 6/0028; A63B 21/00181; A63B 21/0058; A63B 25/10; A61H 1/024; A61H 3/00; A61H 2201/1207; A61H 2201/1642; A61H 2201/5061

USPC ..... 601/5, 23, 27, 33, 34, 35; 602/5, 16, 19, 602/23–27

See application file for complete search history.

(56) References Cited

U.S. PATENT DOCUMENTS

| | | | | |
|---|---|---|---|---|
| 2005/0059908 | A1* | 3/2005 | Bogert | 601/5 |
| 2007/0129653 | A1* | 6/2007 | Sugar et al. | 601/5 |
| 2012/0271207 | A1* | 10/2012 | Schoen et al. | 601/34 |

* cited by examiner

*Primary Examiner* — Quang D Thanh

(74) *Attorney, Agent, or Firm* — Thomas | Horstemeyer, LLP

(57) ABSTRACT

The present invention discloses a movement facilitative device, basically comprising a first fixing module, a second fixing module, an energy storing module and a switching module, wherein the first fixing module and the second fixing module are fixed on the first extremity and the second extremity of the animal respectively. The first fixing module is connected with the second fixing module. The present invention has the advantages of decreasing the force required by the muscles during the exercise as well as retarding the impact enforced thereon while the user is jogging or exercising. Furthermore, the switching module of the present invention minimizes the limitations to the movement of the user so as to let the user exercise more effortlessly.

9 Claims, 6 Drawing Sheets

MOVEMENT FACILITATIVE DEVICE

CROSS-REFERENCE TO RELATED APPLICATION

This application claims priority to and the benefit of Taiwan Application Serial Number 100125742, filed on Jul. 21, 2011, which is incorporated by reference in its entirety.

BACKGROUND OF THE INVENTION

1. Field of the Invention

The present invention relates to a movement facilitative device, and more particularly, the movement facilitative device has a switching module capable of switching into an engaged position and a disengaged position.

2. Description of the Prior Art

Since the muscular endurance and knee joints of human bodies will degrade naturally with age, people may suffer from joint pain or muscle soreness during exercises, and cannot be as agile as ever.

Please refer to FIG. 1. FIG. 1 is a schematic diagram of a prior art. As shown in FIG. 1, Taiwan patent application No. 96214735 discloses a structure of bouncing stilt, wherein the prior structure is L-shaped for foot to step on and leg to be fixed by straps. Moreover, the structure of bouncing shoes comprises an elastic slat, the top thereof is joined with the top of the L-shaped structure and the bottom thereof contacts with the ground surface, so as to absorb a certain degree of the impact of knees. However, this prior structure not only limits the movement of legs and causes an abnormal gait as users walk or run, but also leads to the possibility of losing balance and even to fall down.

Furthermore, considering the muscle strength of users may be insufficient, how to develop a movement facilitative device with simple structure which can let the user exercise more effortlessly and securely is a major preoccupation.

SUMMARY OF THE INVENTION

Therefore, the present invention discloses a movement facilitative device, basically comprising a first fixing module, a second fixing module, an energy storing module and a switching module, wherein the first fixing module and the second fixing module are configured on a first extremity and a second extremity of an animal respectively and the first fixing module is connected with the second fixing module.

The energy storing module is utilized for converting and storing potential and kinetic energy, moreover, the energy storing module has a first end connected with the first fixing module and a second end connected with the second fixing module. The switching module is connected with the second fixing module and the energy storing module, and has an engaged position and a disengaged position; wherein when the switching module is in the engaged position, the first end and the second end of the energy storing module are fixed on the first fixing module and the second fixing module respectively; and when the switching module is in the disengaged position, the second end of the energy storing module is movably connected with the second fixing module.

In actual application, the first fixing module and the second fixing module are interconnected by a junction point with one degree of freedom. Additionally, the movement facilitative device of present invention further comprises a third fixing module fixed on a third extremity of an animal, wherein the third extremity is connected with the second extremity.

Furthermore, the switching module may comprise an upper pushrod, a lower pushrod and a driving member, wherein the upper pushrod has a first junction point and a second junction point. The first junction point is connected with the second fixing module and the energy storing module. To be noticed, the lower pushrod is connected with the third fixing module and interconnected with the upper pushrod by the second junction point with one degree of freedom. And, the driving member is connected with the second junction point and provides a force opposite to the degree of freedom of the junction point, so as to dispose the upper pushrod and the lower pushrod into the engaged position or the disengaged position.

In addition, the switching module may further comprise a slide rail and a slider, wherein the slide rail is fixed on the second fixing module, and the slider is inserted into the slide rail and correlated with the second end of the energy storing module for restricting the movement of the second end along the slide rail. In order to improve the glide performance, the switching module may further comprise a bearing and a driving shaft; wherein the bearing is configured on the slider and the driving shaft is connected with the bearing and the second end, so as to enable the second end to rotate with respect to the upper pushrod.

In actual application, the switching module may further comprise a status sensing module which is mounted on the third fixing module and connected with the driving member. The status sensing module can control the driving member according to the status of the third extremity, so that the driving member may provide a force opposite to the degree of freedom of the junction point, so as to dispose the upper pushrod and the lower pushrod into the engaged position or the disengaged position.

In an embodiment, the status sensing module may be a first connecting rod connected and correlated with the third extremity, and correlated with the driving member, and meanwhile, the corresponding driving member is a second connecting rod. In another embodiment, the status sensing module may be an electronic sensor connected with the third extremity and coupled with the driving member for generating a status signal according to the status of the third extremity, wherein the driving member is an electrodynamic converting device. Besides, the status sensing module may be a flexible rigging which has a first rope end and a second rope end; wherein the first rope end is connected and correlated with the third extremity as well as a second rope end is connected with the driving member; in the meantime, the driving member can be a second connecting rod.

To sum up, the movement facilitative device of the present invention has the advantages of decreasing the force required by the muscles during the exercise as well as retarding the impact enforced thereon while the user is jogging or exercising. Furthermore, the switching module of the present invention minimizes the limitations to the movement of the user so as to let the user exercise more effortlessly.

Many other advantages and features of the present invention will be further understood by the detailed description and the accompanying sheets of drawings.

BRIEF DESCRIPTION OF THE APPENDED DRAWINGS

To facilitate understanding, identical reference numerals have been used, where possible to designate identical elements that are common to the figures.

DETAILED DESCRIPTION OF THE INVENTION

Figure 1:
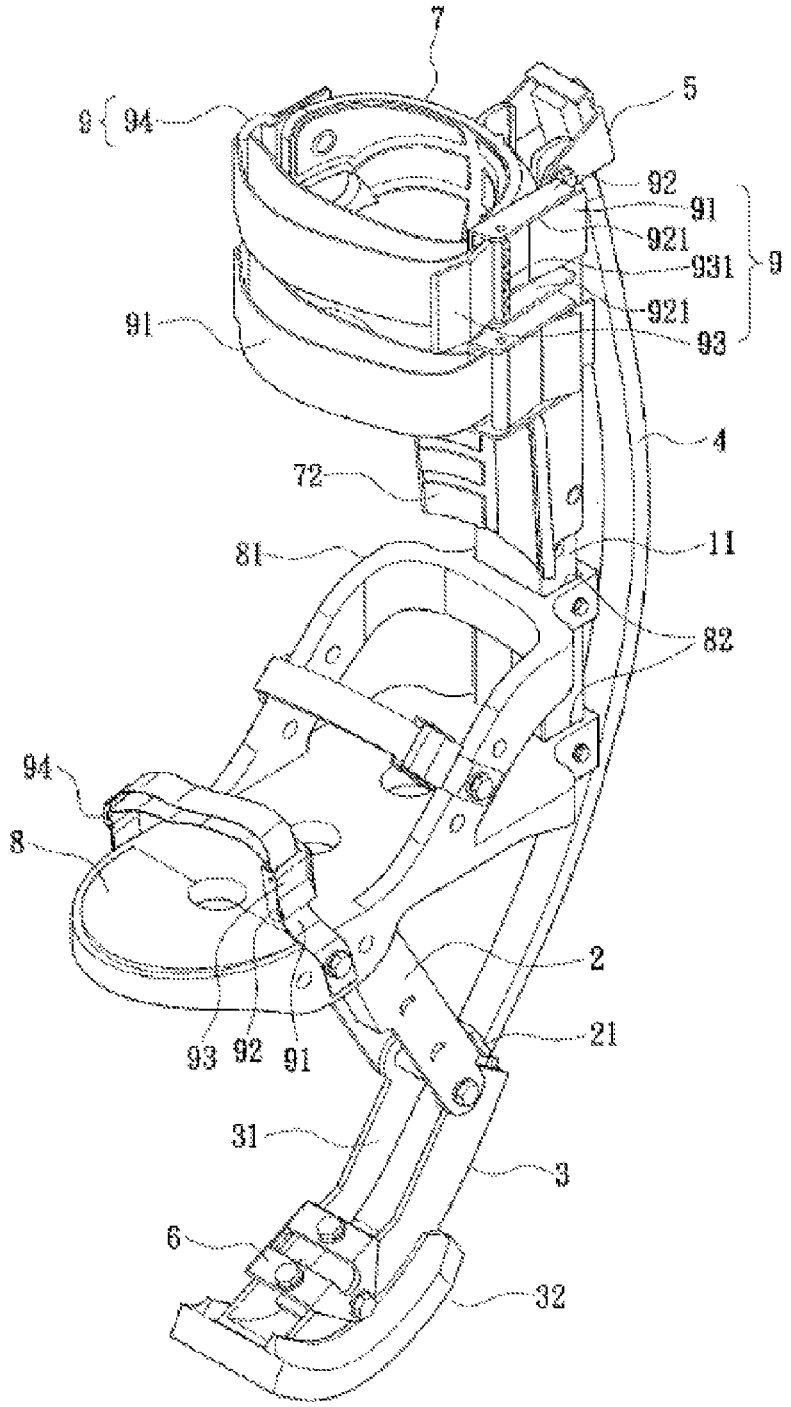
FIG. 1 (Prior Art)
FIG. 1 is a schematic diagram of a prior art.
Figure 2A:
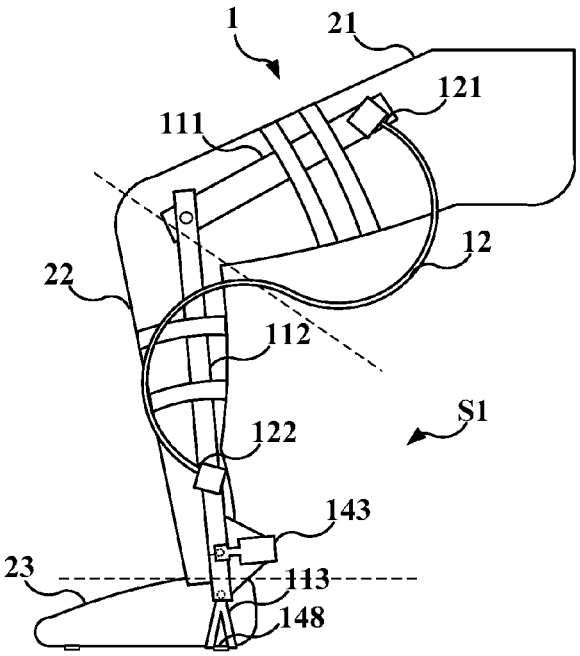
FIG. 2A is a schematic diagram illustrating a movement facilitative device according to an embodiment of the present invention.

The invention discloses a movement facilitative device, and more particularly, the movement facilitative device is fixed with a limb of an animal Please refer to FIG. 2A. FIG. 2A is a schematic diagram illustrating a movement facilitative device according to an embodiment of the present invention. In this embodiment, the movement facilitative device consists of fixing modules, energy story module, and switching module. The detailed description of the components mentioned above illustrates as follows.

The movement facilitative device 1 of the present invention comprises a first fixing module 111, a second fixing module 112, and a third fixing module 113, which are fixed on a first extremity 21, a second extremity 22, and a third extremity 23 of an animal respectively. In the embodiment, the first extremity 21 represents a thigh, the second extremity 22 represents a lower leg, and the third extremity 23 means a foot; wherein the first extremity 21, the second extremity 22, and the third extremity 23 are connected with each other.

Figure 2B:
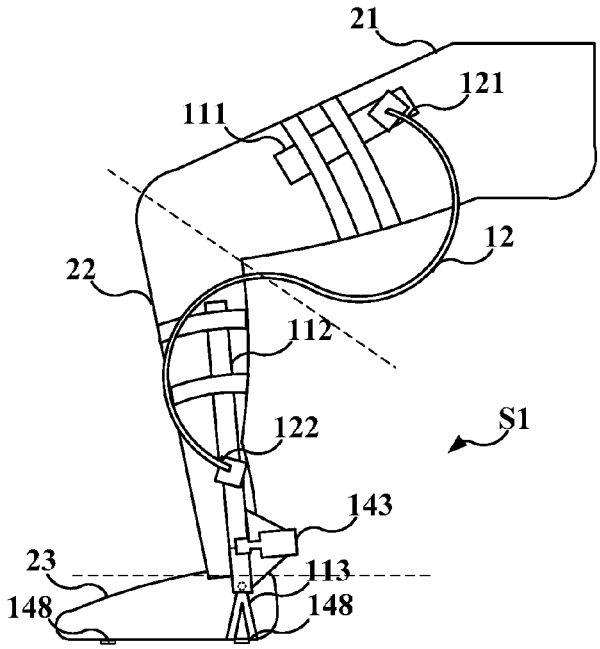
FIG. 2B is a schematic diagram illustrating a movement facilitative device according to another embodiment of the present invention.

More specifically, the first fixing module 111, the second fixing module 112, and the third fixing module 113 of the movement facilitative device 1 are respectively fixed with thigh, lower leg, and foot of a human body by adhering or in other manners, wherein the first fixing module 111 and the second fixing module 112 are interconnected by a junction point with one degree of freedom, but it is not limited to this. The third fixing module 113 may be fixed under the foot for stepping on and contacting with ground. The first fixing module 111 and the second fixing module 112 can be configured separately, as shown in FIG. 2B. FIG. 2B is a schematic diagram illustrating a movement facilitative device according to another embodiment of the present invention.

As shown in FIG. 2B, the energy storing module 12 has a first end 121 and a second end 122. The first end 121 is connected with the first fixing module 111, and the second end 122 is connected with the second fixing module 112. To be noticed, the relative configuration of the first end 121 and the first fixing module 111 is not limited to be a rigid coupled type; in this embodiment, the first end 121 may be connected with the first fixing module 111 by a pivoted joint.

Moreover, the energy storing module 12 is utilized for converting and storing potential and kinetic energy. More specifically, the energy storing module 12 may produce an elastic deformation and absorb a part of gravitational potential energy and kinetic energy when the user steps onto the ground at a certain speed; wherein the energy stored in the energy storing module 12 can be discharged when the limb of user is lifted from the ground, so as to decrease the force required by the muscles during the exercise.

In this embodiment, the energy storing module 12 has an S-shaped appearance, as shown in FIG. 2B. However, the energy storing module 12 of the present invention is not limited to be S-shaped, and may be J-shaped, C-shaped, spiral-shaped, or other shapes according to the manner of execution. Additionally, in this embodiment, the energy storing module 12 is one-piece-formed and has a uniform thickness and width, but it is not limited to this. The shape, appearance, and material of the energy storing module 12 can be modified and adjusted for providing an adequate resistance against the deformation.

Besides of the energy storing module 12, another main technical characteristic of the present invention is the switching module 14. To be understood more clearly, the switching module 14 is exemplified as a module having an engaged position Si and a disengaged position S2.

The engaged position S1 is defined as when the first fixing module 111 and the second fixing module 112 are fixed with the first extremity 21 and the second extremity 22 respectively; the disengaged position S2 is defined as when the first fixing module 111 is fixed with the first extremity 21, and meanwhile, the second fixing module 112 is connected but not fixed to the second extremity 22. That is to say, when the switching module 14 is in the engaged position S1, the first end 121 and the second end 122 of the energy storing module 12 are fixed on the first fixing module 111 and the second fixing module 112 respectively; and when the switching module 14 is in the disengaged position S2, the second end 122 of the energy storing module 12 is movably connected with the second fixing module 112.

To be more precise, the switching module 14 is connected with the first fixing module 111, the second fixing module 112, and the third fixing module 113 directly or indirectly. The main function of the switching module 14 is to control the correlation between the first fixing module 111, the energy storing module 12, the second fixing module 112 and the third fixing module 113, and be capable of switching into the engaged position or the disengaged position in accordance with the status of user's lower limb. When the user steps onto the ground, the switching module 14 controls the energy storing module 12 to withstand the third fixing module 113, so as to compress or extend the third fixing module 113. On the other hand, when the lower limb of user is lifted from the ground, the switching module 14 controls the energy storing module 12 to be disconnected from the third fixing module 113, so the second end 12 of the energy storing module can be moved along the slide rail 144, and meanwhile allowing the knee to bend freely up and down.

Figures 3A, 3B:
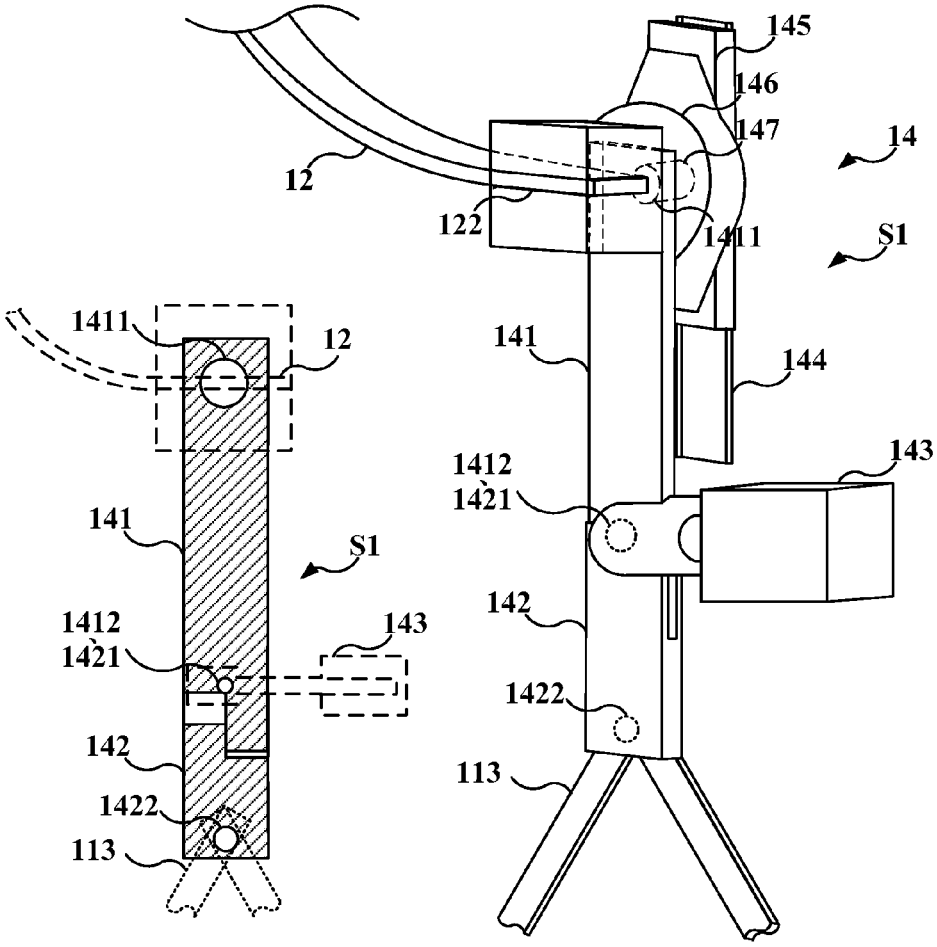
FIG. 3A is an application illustration of the switching module according to an embodiment of the present invention.
FIG. 3B is a part sectioned view of the switching module according to FIG. 3A.
Figures 4A, 4B, 4C:
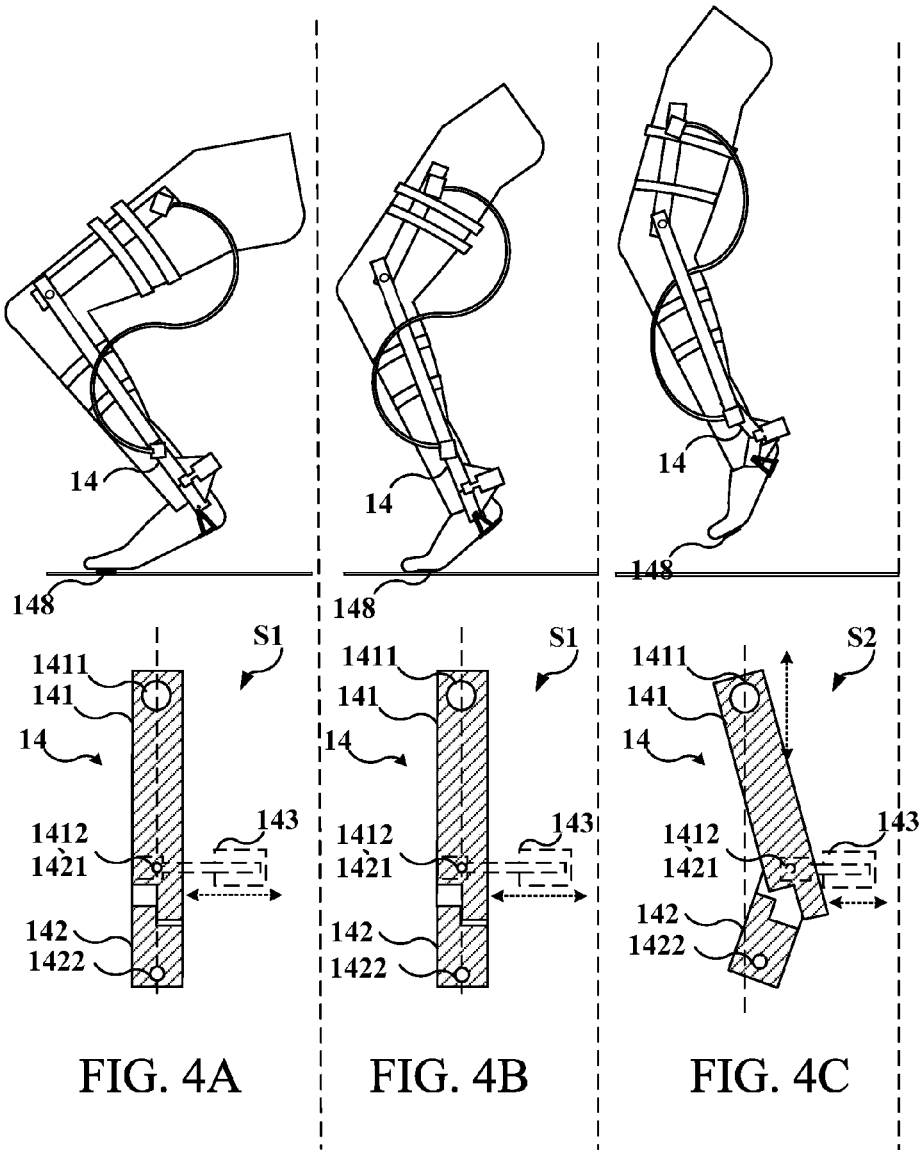
FIG. 4A is a contrast diagram illustrating the operational condition of the present invention and its corresponding status of the switching module.
FIG. 4B is a contrast diagram illustrating the operational condition of the present invention and its corresponding status of the switching module.
FIG. 4C is a contrast diagram illustrating the operational condition of the present invention and its corresponding status of the switching module.

Please refer to FIG. 3A, 3B, and 4A to 4C. FIG. 3A is an application illustration of the switching module according to an embodiment of the present invention; FIG. 3B is a part sectioned view of the switching module according to FIG. 3A; and, FIG. 4A to 4C are the contrast diagrams illustrating the operational condition of the present invention and its corresponding status of the switching module respectively.

As shown in FIG. 3A, 3B, and 4A to 4C, the switching module 14 of the present invention comprises an upper pushrod 141, a lower pushrod 142, a driving member 143, a slide rail 144, a slider 145, a bearing 146, and a driving shaft 147. The upper pushrod 141 has a first junction point 1411 and a second junction point 1412, wherein the first junction point 1411 is connected with the second fixing module 112 and the energy storing module 12; the lower pushrod 142 has a third junction point 1421 and a fourth junction point 1422. However, the design of the switching module 14 can be adjusted by demand, and is not limited to the description above. Any components or devices connected with the second fixing module and the energy storing module and capable of switching into an engaged position or a disengaged position may be served as the switching module 14. More specifically, the switching module 14 can control the actuation by hydraulic system or magnetorheological damper.

In the embodiment, the first junction point 1411, the second junction point 1412, the third junction point 1421 and the fourth junction point 1422 are the through holes with one degree of freedom. The first junction point 1411 is used for providing the driving shaft 147 to penetrate in, and connected with the second fixing module 112 and the energy storing module 12. Furthermore, the slide rail 144 is fixed on the surface of the second fixing module 112; the driving shaft 147 is connected with the bearing 146 and the second end 122 of the energy storing module 12; and, the bearing 146 is configured on the slider 145; wherein the slider 145 is inserted into the slide rail 144 movably for allowing the slider 145 and the bearing 146 may be glided along the slide rail 144, and correlated with the second end 122 of the energy storing module 12 for restricting the movement of the second end 122 along the slide rail 144 and capable of proceeding a corresponding rotation with respect to the upper pushrod 141 or the bearing 146. In addition, the driving member 143 is bolted to the second junction point 1412 of the upper pushrod 141 and the third junction point 1421 of the lower pushrod 142 by a column body, so as to correlate the upper pushrod 141 with the lower pushrod 142. The fourth junction point 1422 is fix-bolted to the third fixing module 113.

Furthermore, when the user steps onto the ground, the switching module 14 is in the engaged position S1, and meanwhile, the upper pushrod 141 is aliened with the lower pushrod 142. Therefore, the second end 122 of the energy storing module 12 applies a force to the first junction point 1411 of the upper pushrod 141 in the vertical direction, and the force is transmitted into the third fixing module 113 along the upper pushrod 141 and the lower pushrod 142, and then further to be transmitted into the ground. Accordingly, a ground reaction force is generated to resist the first end 121 and the second end 122 of the energy storing module 12 respectively. With the gravitational potential energy and kinetic energy stored in the energy storing module 12, the force required by the muscles during the exercise can be decreased as well as to soothe the knee joints.

However, if the user does not step on the ground but the switching module 14 is still maintained in the engaged position S1, the movement of the limbs of the user would be restricted by the energy storing module 12. Therefore, the switching module 14 of the present invention further comprises a status sensing module 148 which is mounted on the third fixing module 113 and connected with the driving member 143, for control the driving member 143 according to the status of the third extremity 23 of user, so as to release the engaged position Si between the energy storing module 12 and the second fixing module 112.

More specifically, when the status sensing module 148 detects that the user does not step on the ground, the driving member 143 may pull or push the second junction point 1412 of the upper pushrod 141 and the third junction point 1421 of the lower pushrod 142 along a horizontal direction, and proceed a corresponding rotation between the upper pushrod 141 and the lower pushrod 142, so as to remove the correlation between the second fixing module 112 and the third fixing module 113, and further to switch into a disengaged position S2. Therefore, when the switching module 14 is in the disengaged position S2, the second end 122 of the energy storing module 12 may be glided along the slide rail 144. Furthermore, when the user steps onto the ground again and the status sensing module 148 generates a status signal, the driving member 143 may apply a horizontal force to the second junction point 1412 and the third junction point 1421, hence, the first junction point 1411 and the second junction point 1412 of the upper pushrod 141 may be perpendicular to the third junction point 1421 and the fourth junction point 1422 of the lower pushrod 142, so as to return into the engaged position S1.

In the embodiment, the status sensing module 148 is an electronic sensor mounted on the surface of the third extremity 23 and coupled with the driving member 143; and the driving member 143 is an electrodynamic converting device. When the third extremity 23 steps onto the ground, the electronic sensor is under pressure and further to generate a status signal for the driving member 143, so the switching module 14 may switch into the engaged position S1. More specifically, the electronic sensor may be a depressed key, a piezoelectric material, a piston, or in other manners; and the electrodynamic converting device may be an electric piston, an electric motor or other device which can convert electric energy into dynamic energy. To be noticed, the driving member 143 may be a connecting rod, a traction rope, or a piston driven by fluid pressure, but is not limited to be these embodiments.

Figure 5:
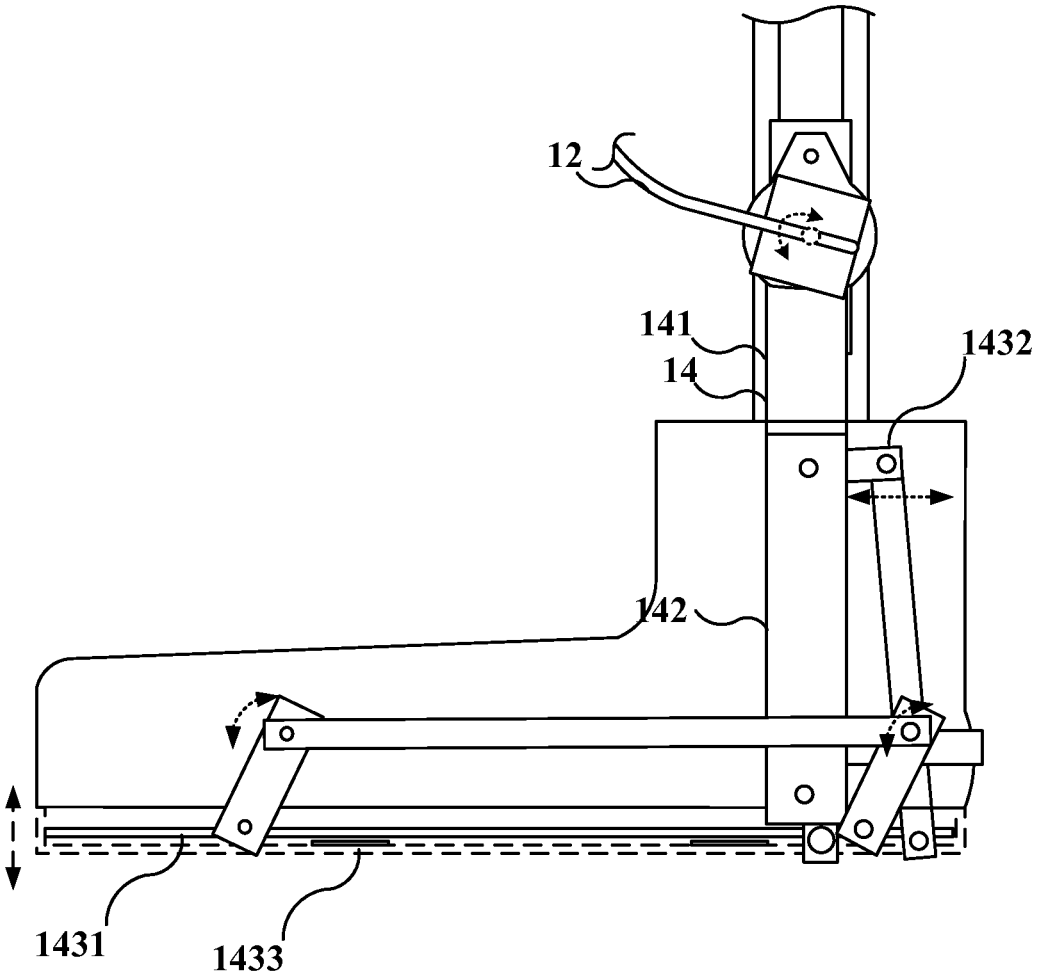
FIG. 5 is a schematic diagram illustrating a status sensing module according to another embodiment of the present invention.

Please refer to FIG. 5. FIG. 5 is a schematic diagram illustrating a status sensing module according to another embodiment of the present invention. Compared with the embodiment of the FIG. 3A, the difference is that the status sensing module 148 and the driving member 143 are a first connecting rod 1431 and a second connecting rod 1432 correlated with each other, respectively. When the third extremity 23 of user steps onto the ground, the first connecting rod 1431 connected and correlated with the third fixing module 113 is driven to actuate the second connecting rod 1432 along a horizontal direction, so as to allow the first junction point 1411, the second junction point 1412 and the third junction point 1421 to be in alignment, and the switching module 14 to be in the engaged position S1. When the third extremity 23 lifts from the ground, the spring 1433 correlated with the first connecting rod 1431 is driven to move the second connecting rod 1432 toward the direction opposite to the actuated direction in the engaged position S1, so as to allow the switching module 14 to be in the disengaged position S2.

Figure 6:
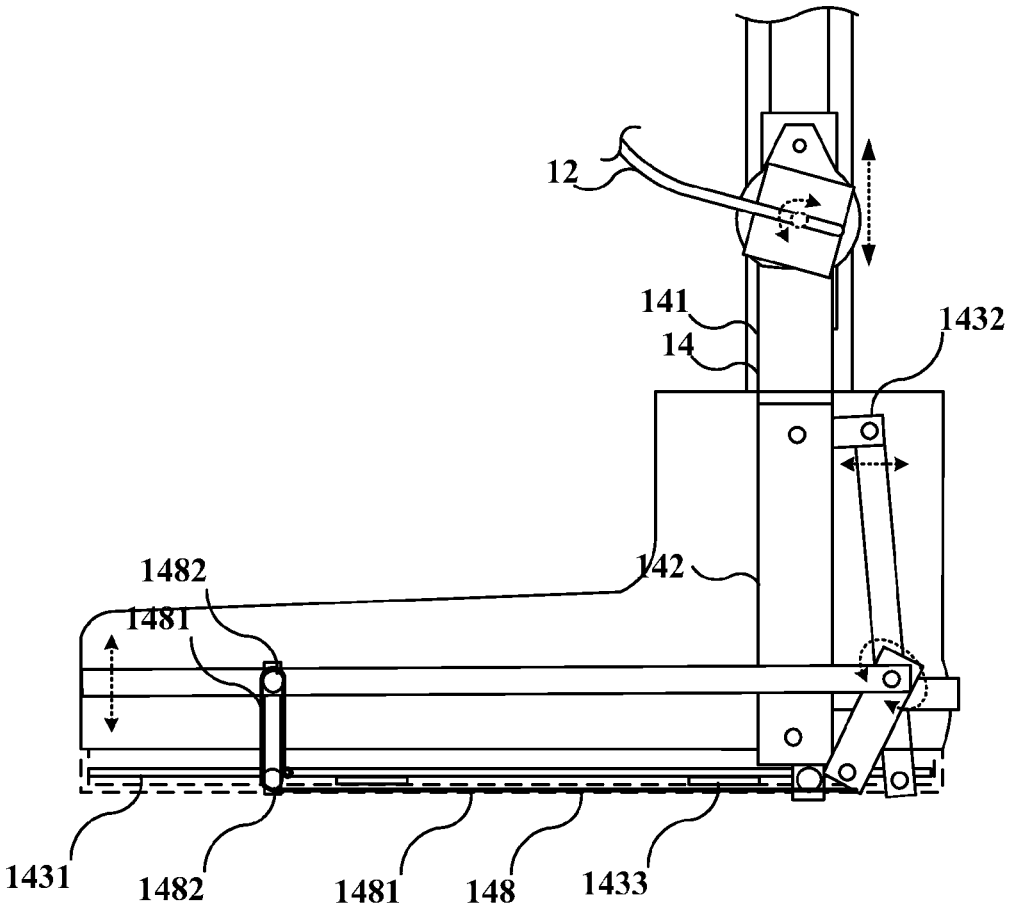
FIG. 6 is a schematic diagram illustrating a status sensing module according to another embodiment of the present invention.

Please refer to FIG. 6. FIG. 6 is a schematic diagram illustrating a status sensing module according to another embodiment of the present invention. Compared with the embodiment of the FIG. 5, the status sensing module 148 in this embodiment is a flexible rigging 1481 which has a first rope end connected and correlated with the third extremity 23 and a second rope end connected with the driving member 143. In this embodiment, the driving member 143 is a second connecting rod 1432; moreover, the second connecting rod 1432 may be replaced by spring 1433, roller wheel 1482 or traction rope.

According to the above stated, the present invention has the advantages of decreasing the force required by the muscles during the exercise as well as retarding the impact enforced thereon while the user is jogging or exercising. Furthermore, the switching module of the present invention minimizes the limitations to the movement of the user so as to let the user exercise more effortlessly.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A movement facilitative device, comprising:

a first fixing module adapted to be fixed on a first extremity of an animal;

a second fixing module adapted to be fixed on a second extremity connected with the first extremity, of the animal;

an energy storing module for converting and storing potential and kinetic energy, and having a first end connected with the first fixing module and a second end connected with the second fixing module; and a switching module, connected with the second fixing module and the energy storing module, having an engaged position and a disengaged position; wherein the switching module further comprises: a slide rail fixed on the second fixing module; and a slider inserted into the slide rail and correlated with the second end of the energy storing module for restricting a movement of the second end along the slide rail;

wherein when the switching module is in the engaged position, the first end and the second end of the energy storing module are fixed on the first fixing module and the second fixing module respectively; and when the switching module is in the disengaged position, the second end of the energy storing module is movably connected with the second fixing module.

2. The movement facilitative device of claim 1, wherein the first fixing module and the second fixing module are interconnected by a junction point with one degree of freedom.

3. The movement facilitative device of claim 1, further comprising:

a third fixing module adapted to be fixed on a third extremity of the animal, wherein the third extremity is connected with the second extremity.

4. The movement facilitative device of claim 3, wherein the switching module comprises:

an upper pushrod having a first junction point and a second junction point, wherein the first junction point is connected with the second fixing module and the energy storing module;

a lower pushrod, connected with the third fixing module, interconnected with the upper pushrod by the second junction point with one degree of freedom; and a driving member, connected with the second junction point, providing a force opposite to the degree of freedom of the second junction point, so as to dispose the upper pushrod and the lower pushrod into the engaged position or the disengaged position.

5. The movement facilitative device of claim 4, wherein the switching module comprises:

a bearing configured on the slider; and a driving shaft connected with the bearing and the second end of the energy storing module, so as to enable the second end to rotate with respect to the upper pushrod.

6. The movement facilitative device of claim 4, wherein the switching module further comprises a status sensing module mounted on the third fixing module and connected with the driving member for controlling the driving member according to a status of the third extremity, and the driving member is providing the force opposite to the degree of freedom of the second junction point, so as to dispose the upper pushrod and the lower pushrod into the engaged position or the disengaged position; wherein the status of the third extremity is that the third extremity is stepped onto the ground or the third extremity is lifted from the ground.

7. The movement facilitative device of claim 6, wherein the status sensing module is a first connecting rod, adapted to be connected and correlated with the third extremity, correlated with the driving member, and the driving member is a second connecting rod.

8. The movement facilitative device of claim 6, wherein the status sensing module is an electronic sensor adapted to be connected with the third extremity and coupled with the driving member for generating a status signal according to the status of the third extremity, and the driving member is an electrodynamic converting device.

9. The movement facilitative device of claim 6, wherein the status sensing module is a flexible rigging which has a first rope end adapted to be connected and correlated with the third extremity as well as a second rope end connected with the driving member, and the driving member is a second connecting rod.

* * * * *